US006513200B2

(12) United States Patent
Yang

(10) Patent No.: US 6,513,200 B2
(45) Date of Patent: Feb. 4, 2003

(54) HIGH PRECISION OPERATING KNOB

(75) Inventor: Guo Liang Yang, Kun-Shan (CN)

(73) Assignee: Hon Hai Precision In D. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/795,861

(22) Filed: Feb. 27, 2001

(65) Prior Publication Data

US 2002/0059695 A1 May 23, 2002

(30) Foreign Application Priority Data

Nov. 17, 2000 (TW) ..... 89219990 U

(51) Int. Cl.[7] ..... E05B 1/00; A45C 13/22

(52) U.S. Cl. ..... 16/441; 16/430; 16/422

(58) Field of Search ..... 16/441, 430, 414, 16/417, 422; 116/200, 201, 286, 284, 309, 319, 320; 74/494, 553; 362/29, 30, 31; 81/177.1, 489, 63.1, 60; D8/300, 307–312, 397–399

(56) References Cited

U.S. PATENT DOCUMENTS 1,391,452 A * 9/1921 Booth ..... 16/DIG. 12
2,725,086 A * 11/1955 Keyes et al. ..... 16/DIG. 12
3,887,963 A * 6/1975 Harmon et al. ..... 16/441
4,488,460 A * 12/1984 Ballone et al. ..... 74/551.9
D278,029 S * 3/1985 Suponitsky ..... D8/397
D347,920 S * 6/1994 Sell ..... D34/33
5,817,037 A * 10/1998 Zurbay ..... 601/135
5,842,764 A * 12/1998 Berardi ..... 116/310
5,870,800 A * 2/1999 Chao ..... 16/441
5,947,671 A * 9/1999 Kanaan et al. ..... 411/408
5,967,006 A * 10/1999 Hillinger ..... 81/177.1
D416,060 S * 11/1999 Angeles ..... D21/694
6,079,298 A * 6/2000 Gasperi et al. ..... 81/177.1
6,112,619 A * 9/2000 Campbell ..... 116/277

FOREIGN PATENT DOCUMENTS

DE 3409562 A1 * 9/1985
DE 19956870 A1 * 6/2001

* cited by examiner

*Primary Examiner*—Chuck Y. Mah
(74) *Attorney, Agent, or Firm*—Wei Te Chung

(57) ABSTRACT

An operating knob (1) includes an upper knob portion (11), a lower knob portion (12), and a neck portion (13) connecting the upper knob portion with the lower knob portion. The upper knob portion is hexagonal in shape and defines a first recess (111) in each of six side edges (112) thereof. The lower knob portion defines a plurality of second recesses (122) in a side edge (124) thereof. A screw hole (14) is axially defined through the lower knob portion into the upper knob portion. The number of second recesses is greater than the number of first recesses. When turning the knob, two to four fingers (21, 22) of the user rotate the upper knob portion in a clockwise or anti-clockwise direction and a thumb (23) of the user pushes the side edge of the lower knob portion in the clockwise or anti-clockwise direction.

11 Claims, 5 Drawing Sheets

HIGH PRECISION OPERATING KNOB

BACKGROUND OF THE INVENTION

1. Field of the Invention

The present invention relates to an operating knob, and particularly to a high precision operating knob having a screw therein/thereon, the knob being suitable for a user to rotate.

2. Description of the Related Art

In the prior art, an operating knob used to adjust the setting of test and measuring equipment or machines is usually a simple knob mounted on a rod. This type of operating knob is often hexagonal in shape. Such a knob defines six recesses in side edges thereof, each recess corresponding to a side of a hexagon, for permitting the fingers, including the thumb, of a user to rotate the knob. When using this type of knob to make fine accuracy adjustments, the thumb must be parallel to the other four fingers. This orientation of the thumb and finger is tiring and makes precise movement of the knob difficult.

Hence, an improved operating knob is required to overcome the disadvantages of the prior art.

BRIEF SUMMARY OF THE INVENTION

A main object of the present invention is to provide a high-precision operating knob suitable for a user to handle when adjusting a machine setting with precision.

An operating knob comprises an upper knob portion, a lower knob portion, and a neck portion connecting the upper knob portion with the lower knob portion. The upper knob portion is hexagonal in shape and defines six first recesses in side edges thereof. The lower knob portion defines a plurality of second recesses in a side edge thereof. A screw hole is defined axially through the operating knob, penetrating through the lower knob portion and into the upper knob portion. The knob is mounted in a position on a place of equipment or a machine such that the axis of the screw hole is substantially perpendicular to the user's forearm. To use the high-precision operating knob, two to four of the user's fingers are engaged with the first recesses of the upper knob portion, and the thumb is pressed against the side edge of the lower knob portion. When turning the knob, the two to four fingers of the user rotate the upper knob portion in a clockwise or anti-clockwise direction and the thumb pushes the side edge of the lower knob portion in the clockwise or anti-clockwise direction. During this rotation movement, the user's fingers are substantially perpendicular to the user's thumb.

Other objects, advantages and novel features of the invention will become more apparent from the following detailed description of the present embodiment when taken in conjunction with the accompanying drawings.

DETAILED DESCRIPTION OF THE INVENTION

Figure 1:
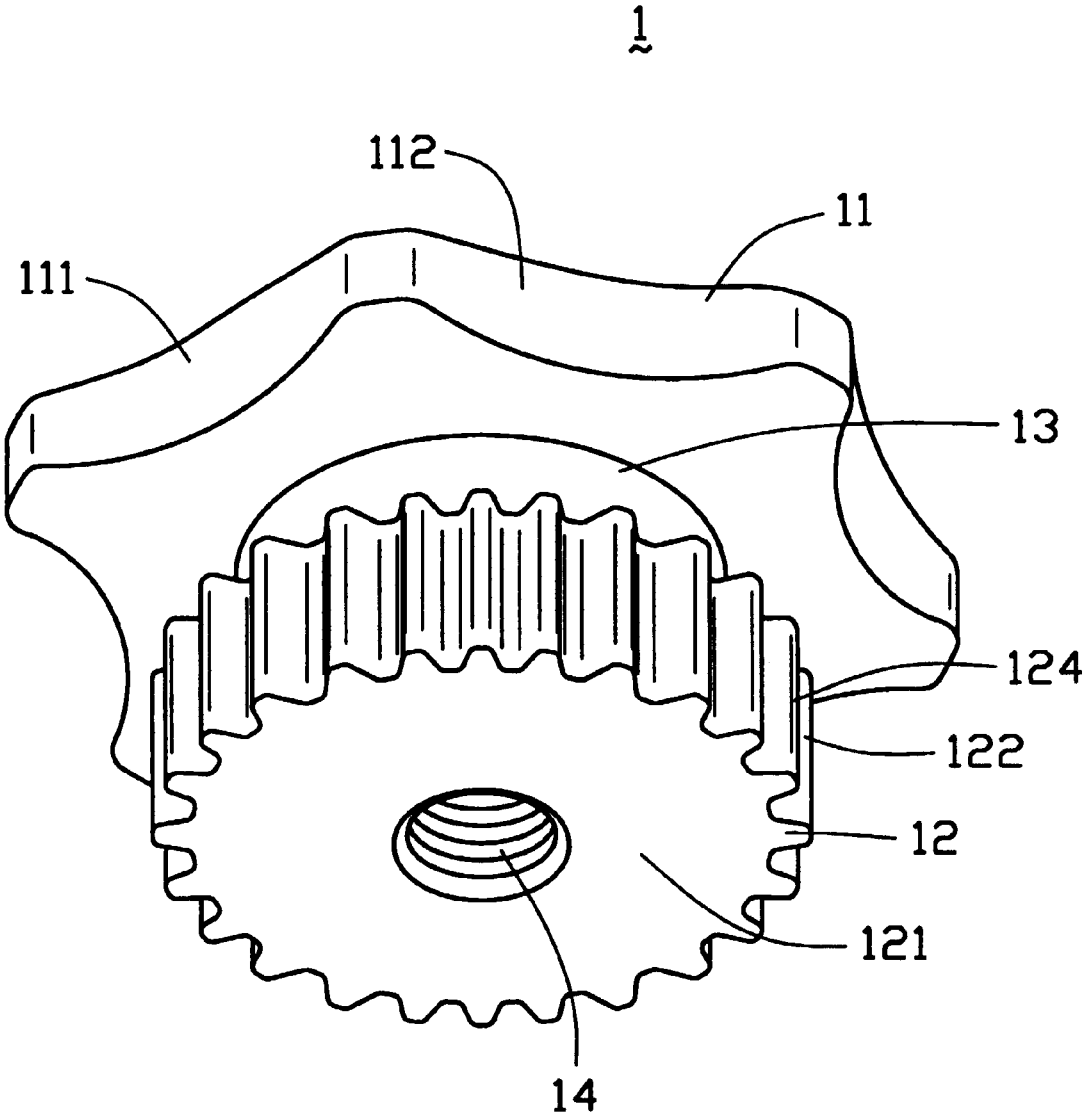
FIG. 1 is a perspective view of a knob in accordance with a first embodiment of the present invention.
Figure 2:
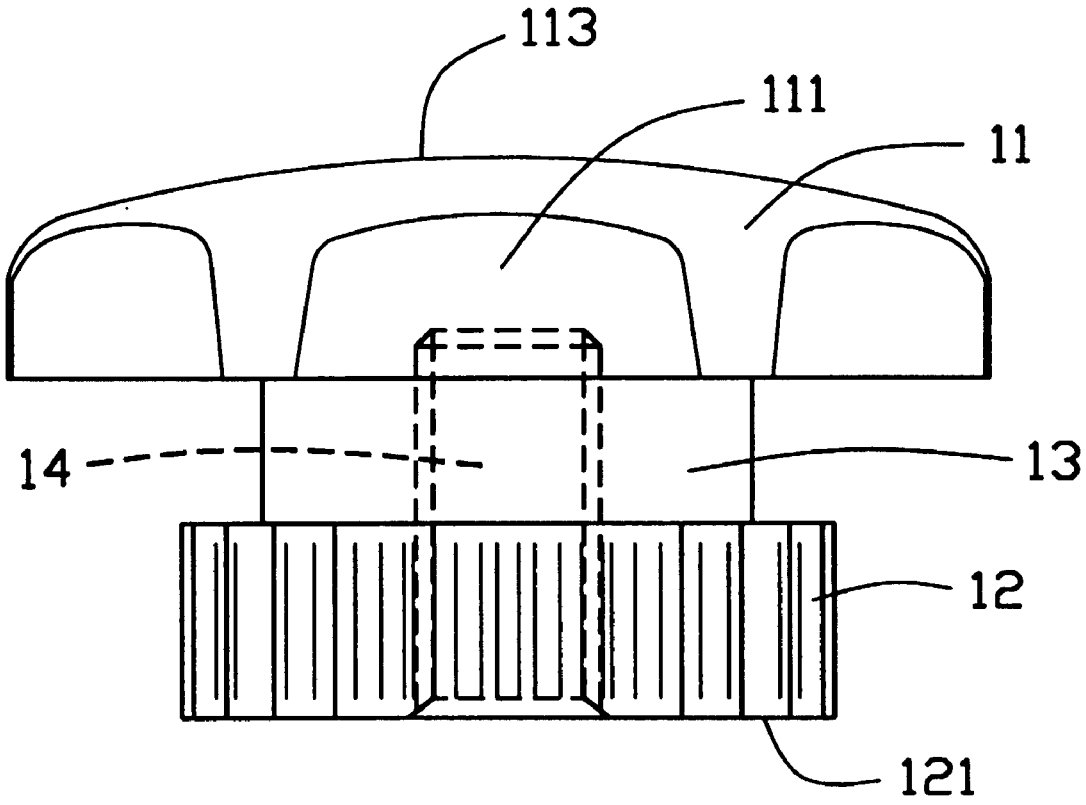
FIG. 2 is a side view of the knob of FIG. 1.
Figure 3:
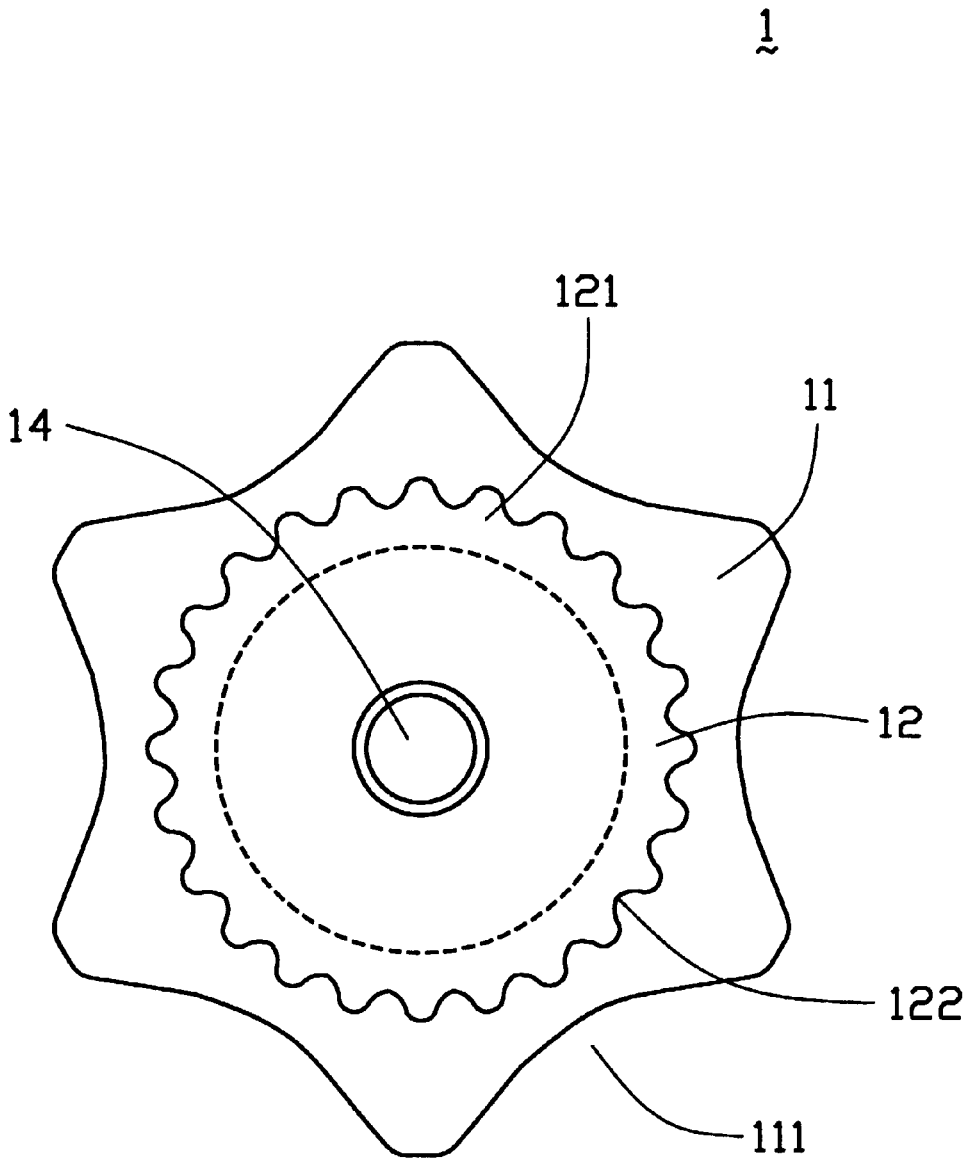
FIG. 3 is a bottom view of the knob of FIG. 1.

Referring to FIGS. 1–3, a high-precision operating knob 1 for mounting on testing or measurement equipment comprises an upper/outer knob portion 11, a lower/inner knob portion 12, and a neck portion 13 integrally connecting the upper knob portion 11 with the lower knob portion 12.

The upper knob portion 11 is hexagonal in shape and defines a first recess 111 in each of six side edges 112 thereof. The upper knob portion 11 has an arcuate top face 113 suitable for fitting the palm of a user's hand. The upper knob portion 11 has a first radius (not labeled).

The lower knob portion 12 is approximately cylindrical in shape and has a common axis of rotation and symmetry with the upper knob portion 11. The lower knob portion 12 defines a plurality of second recesses 122 in a side edge 124 thereof. The lower knob portion 12 has a second radius (not labeled). The second radius of the lower knob portion 12 is shorter than the first radius of the upper knob-portion 11.

A screw hole 14 is defined axially through the operating knob 1 from a bottom face 121 of the lower knob portion 12 and penetrating through the lower knob portion 12 to the upper knob portion 11.

Figure 4:
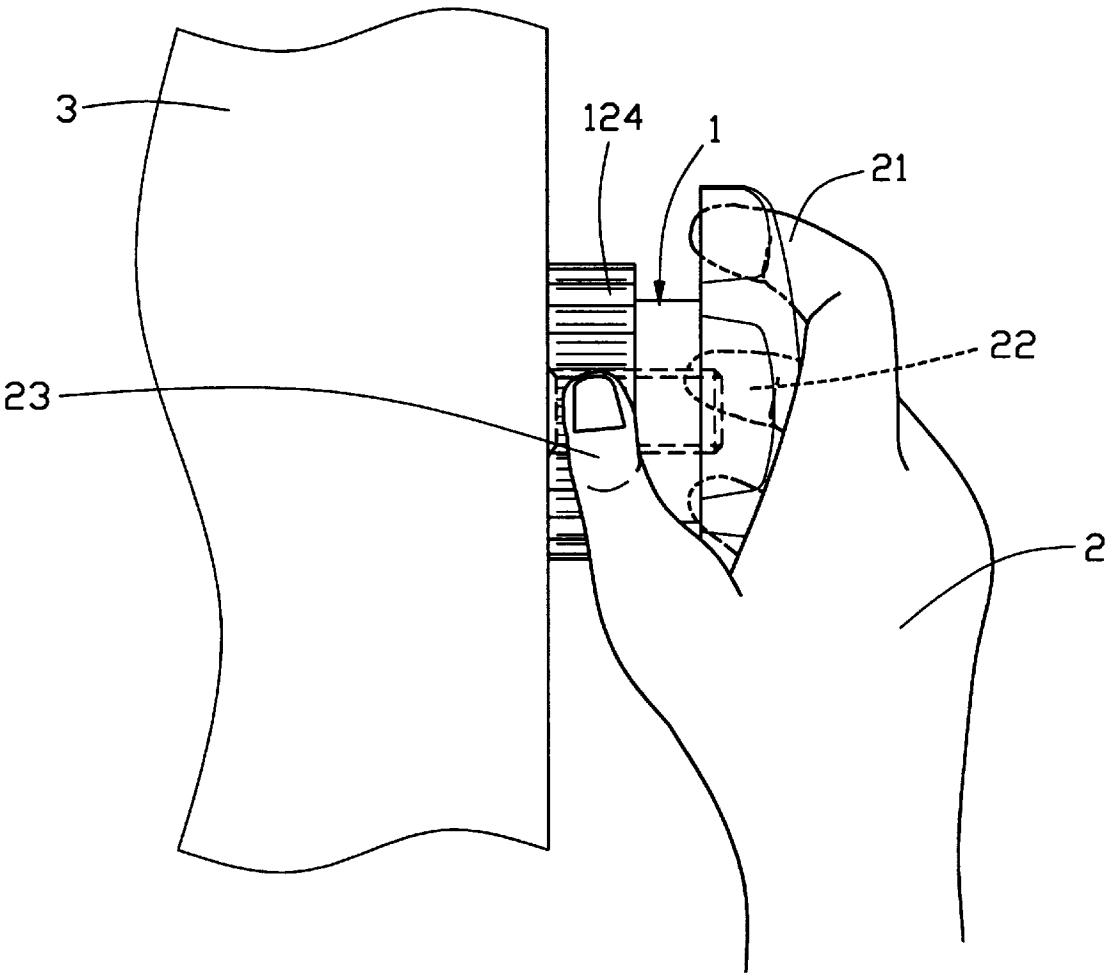
FIG. 4 is a side view of the knob of FIG. 1 with a user's hand operating the knob.

Referring to FIG. 4, the knob 1 is mounted on a piece of equipment 3 such that the axis of the screw hole 14 is substantially perpendicular to the user's fore arm 2. To use the high-precision operating knob 1, two to four of the user's fingers 21, 22 are engaged with the first recesses 111 of the upper knob portion 11, and the thumb 23 is pressed against the side edge 124 of the lower knob portion 12. When turning the knob 1, the two to four fingers 21, 22 of the user rotate the upper knob portion 11 in a clockwise or anti-clockwise direction and the thumb pushes the side edge 124 of the lower knob portion 12 in the clockwise or anti-clockwise direction. During this rotating movement, the user's fingers 21, 22 are substantially perpendicular to the user's thumb 23.

Figure 5:
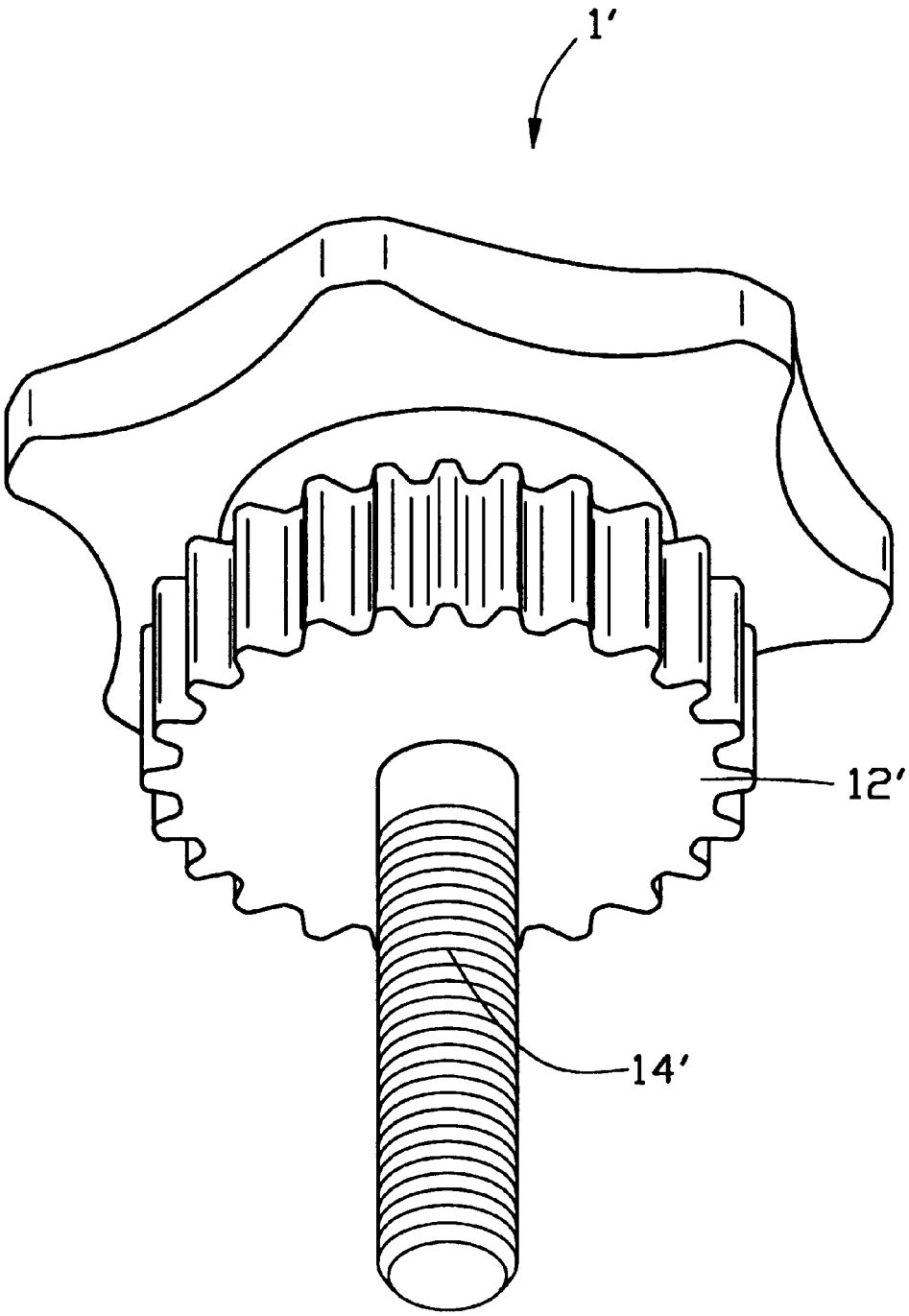
FIG. 5 is a perspective view of a knob in accordance with a second embodiment of the present invention.

Referring to FIG. 5, a knob 1' of the second embodiment of the present invention is similar to the knob 1 of the first embodiment of the present invention except for replacing the screw hole 14 with a screw post 14'. The screw post 14' extends from a lower knob portion 12'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An operating knob used to adjust the setting of test and measuring equipment or machines and mounted with its axis of rotation perpendicular to a user's arm, comprising:

an upper knob portion being polygonal in shape and defining a first recess in each of a plurality of side edges thereof, the first recesses of the upper knob portion being engageable with two to four fingers of the user, the upper knob portion having a first radius;

a lower knob portion connected with and located below the upper knob portion and defining a plurality of second recesses in a side edge thereof, the second recesses of the lower knob portion being engageable with a thumb of the user, the lower knob portion having a second radius shorter than the first radius, the lower knob portion having a common axis of rotation and symmetry with the upper knob portion; and wherein the number of the second recesses of the lower knob portion is more than the number of the first recesses of the upper knob portion.

2. The operating knob as claimed in claim 1, wherein a neck portion integrally connects the upper knob portion with the lower knob portion.

3. The operating knob as claimed in claim 2, wherein a screw hole is defined axially through the operating knob along the axis of rotation and symmetry, penetrating through the lower knob portion and into the upper knob portion.

4. The operating knob as claimed in claim 2, wherein a screw post extends axially along the axis of rotation and symmetry from the lower knob portion.

5. The operating knob as claimed in claim 1, wherein the upper knob portion has an arcuate top face suitable for fitting the palm of the user's hand.

6. The operating knob as claimed in claim 1, wherein the upper knob portion is hexagonal in shape and defines a first recess in each of six side edges thereof.

7. A knob for operating rotatably about an axis, comprising:

an upper knob portion with a first radial dimension forming a first grasping area, along a periphery thereof, adapted to be used with fingers of a user, the first grasping area including a series of first recesses; and a lower knob portion with a second radial dimension forming a second grasping area, along a periphery thereof, adapted to be used with a thumb of the user, the lower knob portion being integrally formed below the upper knob portion, the second grasping area including a series of second recesses; wherein said first radial dimension is larger than said second radial dimension and said second recesses are much denser than said first recesses.

8. In use of an operating knob for adjusting setting of test and measuring equipment or machines, the operating knob comprising an upper knob portion and a lower knob portion connected with and located below the upper knob portion, the upper knob portion being larger than the lower knob portion, the upper knob portion having a plurality of first recesses defined in a side edge thereof, the lower knob portion having a plurality of second recesses defined in a side edge thereof, the number of the first recesses being fewer than the number of the second recesses, the use comprising applying fingers of a user to engage with the upper knob and a thumb of the user to engage with the lower knob to exert a rotating force to the operating knob.

9. The use as claimed in claim 8, wherein a screw means is formed in a center of the operating knob.

10. The use as claimed in claim 9, wherein the screw means is a screw hole.

11. The use as claimed in claim 9, wherein the screw means is a screw post.

* * * * *